US008939474B2

(12) United States Patent
Hagemeyer et al.

(10) Patent No.: US 8,939,474 B2
(45) Date of Patent: Jan. 27, 2015

(54) LOCK WITH SLIDING LOCKING ELEMENTS

(75) Inventors: Bruce Hagemeyer, Pella, IA (US); Dan Raap, Hartford, SD (US); Gary E. Tagtow, Sioux Falls, SD (US); Matt Coplan, Harrisburg, SD (US); Zaiding Shen, Ningbo (CN)

(73) Assignee: Amesbury Group, Inc., Amesbury, MA (US)

( * ) Notice: Subject to any disclaimer, the term of this patent is extended or adjusted under 35 U.S.C. 154(b) by 653 days.

(21) Appl. No.: 13/152,913

(22) Filed: Jun. 3, 2011

(65) Prior Publication Data

US 2012/0306220 A1 Dec. 6, 2012

(51) Int. Cl.

| | |
|---|---|
| ***E05C 1/06*** | (2006.01) |
| ***E05B 63/14*** | (2006.01) |
| ***E05B 65/08*** | (2006.01) |
| *E05C 1/00* | (2006.01) |
| *E05B 65/00* | (2006.01) |
| *E05B 65/02* | (2006.01) |
| *E05B 17/00* | (2006.01) |

(52) U.S. Cl.

CPC ..... *E05B 63/14* (2013.01); *E05B 65/087* (2013.01); *E05B 65/0025* (2013.01); *E05B 65/025* (2013.01); *E05B 2017/0095* (2013.01); *Y10S 292/46* (2013.01)

USPC ..... 292/140; 292/137; 292/163; 292/DIG. 46

(58) Field of Classification Search

USPC ..... 292/137, 138, 140, 163, 169, DIG. 46, 292/DIG. 48, DIG. 50

See application file for complete search history.

(56) References Cited

U.S. PATENT DOCUMENTS

| | | | | |
|---|---|---|---|---|
| 419,384 | A | | 1/1890 | Towne |
| 651,947 | A | | 6/1900 | Johnson |
| 738,280 | A | | 9/1903 | Bell et al. |
| 972,769 | A | * | 10/1910 | Lark ..... 292/157 |
| 1,142,463 | A | * | 6/1915 | Sheperd ..... 292/40 |
| 1,251,467 | A | | 1/1918 | Blixt et al. |
| 1,277,174 | A | | 8/1918 | Bakst |
| 1,359,347 | A | * | 11/1920 | Fleisher ..... 70/104 |
| 1,366,909 | A | * | 2/1921 | Frommer ..... 70/70 |
| 1,596,992 | A | | 8/1926 | Ognowicz |
| 1,646,674 | A | | 10/1927 | Angelillo |
| 1,666,654 | A | * | 4/1928 | Hiering ..... 70/67 |
| 1,716,113 | A | | 6/1929 | Carlson |

(Continued)

FOREIGN PATENT DOCUMENTS

| | | |
|---|---|---|
| AT | 844928 | 12/1920 |
| DE | 1002656 | 2/1957 |

(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.

(Continued)

*Primary Examiner* — Carlos Lugo

(57) ABSTRACT

A lock includes a housing and a slide mechanism adapted to translate in the housing along a locking axis. The lock includes one or more locking elements connected to the slide mechanism. The locking elements translate along the locking axis with the slide mechanism.

13 Claims, 6 Drawing Sheets

(56) References Cited

U.S. PATENT DOCUMENTS

| | | | | |
|---|---|---|---|---|
| 2,535,947 | A | 12/1950 | Newell | |
| 2,739,002 | A | 3/1956 | Johnson | |
| 2,862,750 | A | 12/1958 | Minke | |
| 3,064,462 | A | 11/1962 | Ng et al. | |
| 3,162,472 | A | 12/1964 | Rust | |
| 3,250,100 | A | 5/1966 | Cornaro | |
| 3,332,182 | A * | 7/1967 | Mark | 52/127.12 |
| 3,413,025 | A | 11/1968 | Sperry | |
| 3,437,364 | A | 4/1969 | Walters | |
| RE26,677 | E | 10/1969 | Russell et al. | |
| 3,586,360 | A * | 6/1971 | Perrotta | 292/26 |
| 3,806,171 | A | 4/1974 | Fernandez | |
| 3,899,201 | A | 8/1975 | Paioletti | |
| 3,904,229 | A | 9/1975 | Waldo | |
| 3,953,061 | A * | 4/1976 | Hansen et al. | 292/5 |
| 4,076,289 | A | 2/1978 | Fellows et al. | |
| 4,116,479 | A | 9/1978 | Poe | |
| 4,132,438 | A | 1/1979 | Guymer | |
| 4,236,396 | A * | 12/1980 | Surko et al. | 70/107 |
| 4,288,944 | A * | 9/1981 | Donovan | 49/395 |
| 4,500,122 | A * | 2/1985 | Douglas | 292/161 |
| 4,593,542 | A * | 6/1986 | Rotondi et al. | 70/134 |
| 4,602,812 | A | 7/1986 | Bourner | |
| 4,607,510 | A * | 8/1986 | Shanaan et al. | 70/95 |
| 4,643,005 | A | 2/1987 | Logas | |
| 4,691,543 | A | 9/1987 | Watts | |
| 4,754,624 | A * | 7/1988 | Fleming et al. | 70/95 |
| 4,949,563 | A | 8/1990 | Gerard et al. | |
| 4,961,602 | A * | 10/1990 | Pettersson | 292/98 |
| 4,962,653 | A | 10/1990 | Kaup | |
| 4,962,800 | A * | 10/1990 | Owiriwo | 150/118 |
| 4,964,660 | A | 10/1990 | Prevot et al. | |
| 4,973,091 | A | 11/1990 | Paulson | |
| 5,092,144 | A | 3/1992 | Fleming et al. | |
| 5,118,151 | A | 6/1992 | Nicholas, Jr. et al. | |
| 5,125,703 | A | 6/1992 | Clancy et al. | |
| 5,171,050 | A | 12/1992 | Mascotte | |
| 5,172,944 | A | 12/1992 | Munich et al. | |
| 5,197,771 | A | 3/1993 | Kaup et al. | |
| 5,265,452 | A | 11/1993 | Dawson et al. | |
| 5,290,077 | A | 3/1994 | Fleming | |
| 5,373,716 | A | 12/1994 | MacNeil et al. | |
| 5,382,060 | A | 1/1995 | O'Toole et al. | |
| 5,388,875 | A | 2/1995 | Fleming | |
| 5,404,737 | A | 4/1995 | Hotzl | |
| 5,482,334 | A | 1/1996 | Hotzl | |
| 5,495,731 | A | 3/1996 | Riznik | |
| 5,513,505 | A | 5/1996 | Danes | |
| 5,516,160 | A * | 5/1996 | Kajuch | 292/1.5 |
| 5,524,941 | A | 6/1996 | Fleming | |
| 5,524,942 | A | 6/1996 | Fleming | |
| 5,609,372 | A | 3/1997 | Ponelle | |
| 5,620,216 | A | 4/1997 | Fuller | |
| 5,707,090 | A | 1/1998 | Sedley | |
| 5,716,154 | A * | 2/1998 | Miller et al. | 403/22 |
| 5,722,704 | A | 3/1998 | Chaput et al. | |
| 5,782,114 | A | 7/1998 | Zeus et al. | |
| 5,791,700 | A | 8/1998 | Biro | |
| 5,820,170 | A | 10/1998 | Clancy | |
| 5,820,173 | A | 10/1998 | Fuller | |
| 5,865,479 | A | 2/1999 | Viney | |
| 5,878,606 | A | 3/1999 | Chaput et al. | |
| 5,890,753 | A | 4/1999 | Fuller | |
| 5,896,763 | A | 4/1999 | Dinkelborg et al. | |
| 5,901,989 | A | 5/1999 | Becken et al. | |
| 5,906,403 | A | 5/1999 | Bestler et al. | |
| 5,951,068 | A | 9/1999 | Strong et al. | |
| 6,050,115 | A | 4/2000 | Schroter et al. | |
| 6,094,869 | A | 8/2000 | Magoon et al. | |
| D433,916 | S | 11/2000 | Frey | |
| 6,196,599 | B1 | 3/2001 | D'Hooge | |
| 6,209,931 | B1 | 4/2001 | Von Stoutenborough et al. | |
| 6,217,087 | B1 | 4/2001 | Fuller | |
| 6,250,842 | B1 * | 6/2001 | Kruger | 403/315 |
| 6,257,030 | B1 | 7/2001 | Davis, III et al. | |
| 6,264,252 | B1 | 7/2001 | Clancy | |
| 6,266,981 | B1 | 7/2001 | von Resch et al. | |
| 6,282,929 | B1 | 9/2001 | Eller et al. | |
| 6,283,516 | B1 | 9/2001 | Viney | |
| 6,293,598 | B1 | 9/2001 | Rusiana | |
| 6,327,881 | B1 | 12/2001 | Grundler et al. | |
| 6,389,855 | B2 | 5/2002 | Renz et al. | |
| 6,502,435 | B2 | 1/2003 | Watts et al. | |
| 6,516,641 | B1 | 2/2003 | Segawa | |
| 6,637,784 | B1 | 10/2003 | Hauber et al. | |
| 6,672,632 | B1 | 1/2004 | Speed et al. | |
| 6,688,656 | B1 | 2/2004 | Becken | |
| 6,733,051 | B1 | 5/2004 | Cowper | |
| 6,776,441 | B2 | 8/2004 | Liu | |
| 6,810,699 | B2 | 11/2004 | Nagy | |
| 6,871,451 | B2 | 3/2005 | Harger et al. | |
| 6,935,662 | B1 * | 8/2005 | Hauber et al. | 292/302 |
| 6,971,686 | B2 | 12/2005 | Becken | |
| 6,994,383 | B2 | 2/2006 | Morris | |
| 7,025,394 | B1 | 4/2006 | Hunt | |
| 7,083,206 | B1 | 8/2006 | Johnson | |
| 7,155,946 | B2 | 1/2007 | Lee et al. | |
| 7,207,199 | B2 | 4/2007 | Smith et al. | |
| 7,249,791 | B2 | 7/2007 | Johnson | |
| 7,404,306 | B2 | 7/2008 | Walls et al. | |
| 7,418,845 | B2 | 9/2008 | Timothy | |
| 7,634,928 | B2 | 12/2009 | Hunt | |
| 7,677,067 | B2 | 3/2010 | Riznik et al. | |
| 7,707,862 | B2 | 5/2010 | Walls et al. | |
| 7,726,705 | B2 * | 6/2010 | Kim | 292/163 |
| 7,735,882 | B2 | 6/2010 | Abdollahzadeh et al. | |
| 7,856,856 | B2 | 12/2010 | Shvartz | |
| 7,878,034 | B2 | 2/2011 | Alber et al. | |
| 8,182,002 | B2 | 5/2012 | Fleming | |
| 8,348,308 | B2 | 1/2013 | Hagemeyer et al. | |
| 8,376,414 | B2 | 2/2013 | Nakanishi et al. | |
| 8,382,166 | B2 | 2/2013 | Hagemeyer et al. | |
| 8,398,126 | B2 | 3/2013 | Nakanishi et al. | |
| 2003/0159478 | A1 | 8/2003 | Nagy | |
| 2004/0107746 | A1 | 6/2004 | Chang | |
| 2004/0239121 | A1 | 12/2004 | Morris | |
| 2005/0103066 | A1 | 5/2005 | Botha et al. | |
| 2005/0144848 | A1 | 7/2005 | Harger et al. | |
| 2007/0068205 | A1 | 3/2007 | Timothy | |
| 2007/0080541 | A1 | 4/2007 | Fleming | |
| 2007/0113603 | A1 | 5/2007 | Polster | |
| 2007/0170725 | A1 | 7/2007 | Speyer et al. | |
| 2008/0087052 | A1 | 4/2008 | Abdollahzadeh et al. | |
| 2008/0092606 | A1 | 4/2008 | Meekma | |
| 2008/0141740 | A1 | 6/2008 | Shvartz | |
| 2008/0150300 | A1 | 6/2008 | Harger et al. | |
| 2008/0156048 | A1 | 7/2008 | Topfer | |
| 2008/0156049 | A1 | 7/2008 | Topfer | |
| 2008/0178530 | A1 | 7/2008 | Ellerton et al. | |
| 2008/0179893 | A1 | 7/2008 | Johnson | |
| 2008/0184749 | A1 | 8/2008 | Alber et al. | |
| 2009/0078011 | A1 | 3/2009 | Avni | |
| 2010/0154490 | A1 | 6/2010 | Hagemeyer et al. | |
| 2010/0213724 | A1 | 8/2010 | Uyeda | |
| 2010/0236302 | A1 | 9/2010 | Uyeda | |
| 2011/0198867 | A1 | 8/2011 | Hagemeyer et al. | |
| 2011/0289987 | A1 | 12/2011 | Chiou et al. | |
| 2012/0146346 | A1 | 6/2012 | Hagemeyer et al. | |
| 2013/0019643 | A1 | 1/2013 | Tagtow et al. | |
| 2013/0140833 | A1 | 6/2013 | Hagemeyer et al. | |
| 2013/0152647 | A1 | 6/2013 | Terei et al. | |
| 2013/0234449 | A1 | 9/2013 | Dery et al. | |
| 2014/0060127 | A1 | 3/2014 | Hemmingsen et al. | |
| 2014/0125068 | A1 | 5/2014 | Hagemeyer et al. | |

FOREIGN PATENT DOCUMENTS

| | | |
|---|---|---|
| DE | 1584112 | 9/1969 |
| DE | 2639065 | 3/1977 |
| DE | 3032086 | 3/1982 |
| DE | 3836693 | 5/1990 |
| DE | 9011216 | 10/1990 |
| DE | 4224909 | 2/1993 |
| DE | 29807860 | 8/1998 |

(56) References Cited

FOREIGN PATENT DOCUMENTS

| | | | | |
|---|---|---|---|---|
| DE | 10253240 | | 5/2004 | |
| DE | 202012002743 | U1 | 4/2012 | |
| DE | 202013000920 | U1 | 4/2013 | |
| DE | 202013000921 | U1 | 4/2013 | |
| DE | 202013001328 | U1 | 5/2013 | |
| EP | 7397 | A1 * | 2/1980 | ..... F16B 12/00 |
| EP | 341173 | | 11/1989 | |
| EP | 359284 | | 3/1990 | |
| EP | 661409 | | 7/1995 | |
| EP | 792987 | | 9/1997 | |
| EP | 1106761 | | 6/2001 | |
| EP | 1867817 | | 12/2007 | |
| EP | 2128362 | | 12/2009 | |
| EP | 2273046 | A2 | 1/2011 | |
| EP | 2339099 | A1 | 6/2011 | |
| EP | 2581531 | A1 | 4/2013 | |
| EP | 2584123 | A1 | 4/2013 | |
| EP | 2584124 | A2 | 4/2013 | |
| FR | 1142316 | | 3/1957 | |
| FR | 1201087 | | 12/1959 | |
| FR | 2339723 | | 9/1977 | |
| FR | 2342390 | | 9/1977 | |
| FR | 2344695 | | 10/1977 | |
| FR | 2502673 | | 10/1982 | |
| GB | 226170 | | 4/1925 | |
| GB | 612094 | A | 11/1948 | |
| GB | 1498849 | | 1/1978 | |
| GB | 1575900 | | 10/1980 | |
| GB | 2051214 | | 1/1981 | |
| GB | 2076879 | | 12/1981 | |
| GB | 2115055 | A * | 9/1983 | ..... E05C 1/12 |
| GB | 2122244 | | 1/1984 | |
| GB | 2126644 | | 3/1984 | |
| GB | 2134170 | | 8/1984 | |
| GB | 2136045 | | 9/1984 | |
| GB | 2168747 | | 6/1986 | |
| GB | 2196375 | | 4/1988 | |
| GB | 2212849 | | 8/1989 | |
| GB | 2225052 | | 5/1990 | |
| GB | 2230294 | | 10/1990 | |
| GB | 2242702 | | 10/1991 | |
| GB | 2244512 | | 12/1991 | |
| GB | 2265935 | | 10/1993 | |
| GB | 2270343 | | 3/1994 | |
| GB | 2280474 | | 2/1995 | |
| GB | 2364545 | | 1/2002 | |
| GB | 2496911 | A | 5/2013 | |
| IT | 614960 | | 1/1961 | |
| SE | 309372 | | 3/1969 | |
| WO | 96/25576 | | 8/1996 | |
| WO | 02/33202 | | 4/2002 | |
| WO | 2007/104499 | | 9/2007 | |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco__multipoint__lock__2__cams__2__shootbolt__attachment.html, accessed Oct. 27, 2011, original publication date unknown, 5 pgs.

"LocksOnline.co.uk: Premier Supplier of Security Products", http://www.locksonline.co.uk/acatalog/upvc__Locks.html, accessed Oct. 27, 2011, original publication date unknown, 6 pgs.

"uPVC Window Hardware and uPVC Door Hardware online", http://www.upvc-hardware.co.uk/, accessed Oct. 27, 2011, original publication date unknown, 2 pgs.

* cited by examiner

LOCK WITH SLIDING LOCKING ELEMENTS

INTRODUCTION

In the patio door/sliding glass door manufacturing industry, the most commonly used mortise lock is the single-point lock. A single locking element (e.g., a hook) is usually incorporated into the mortise lock device. Due to their small size and simple construction, manufacture of single hook locks is generally cost effective. Single-point locks suffer the drawback, however, of being somewhat easily broken or disengaged by a fairly insignificant force, thus defeating the purpose for which the lock is intended.

Multi-point locks include two or more locking elements that pivot out of one or more lock housings to engage with keeper elements on a door frame. Multi-point locks offer increased security over single-point locks that include only a single locking element. While more secure, multi-point locks are typically larger than single-point locks and more expensive to manufacture, due to the increased number of complex components utilized in the lock mechanism. Also, most sliding door manufacturers only provide an opening in the door for the smaller, single-point mortise locks.

SUMMARY

In one aspect, the technology relates to a lock having: a housing; a slide mechanism adapted to translate in the housing along a locking axis; and a locking element connected to the slide mechanism, the locking element adapted to translate along the locking axis with the slide mechanism. In an embodiment, the locking element is deflectably connected to the slide mechanism, such that a force applied to the locking element substantially orthogonal to the locking axis deflects the locking element into the housing. In another embodiment, the locking element is biased outward from the housing. In yet another embodiment, the locking element is at least two locking elements. In still another embodiment, the lock includes: a cam rotatably mounted relative to the housing; and a linkage fixed to the cam and slidably engaged with the slide mechanism, wherein rotation of the cam moves the slide mechanism from a first position to a second position.

In another embodiment of the above aspect, the slide mechanism includes a slot and the linkage includes a pin slidably engaged with the slot. In another embodiment, the lock includes a spring for biasing the sliding mechanism in both the first position and the second position. In certain embodiments, the housing defines at least one slot, wherein the slot is substantially parallel to the locking axis. In other embodiments, the sliding mechanism is slidably engaged with the slot. In yet another embodiment, the locking element includes a head, wherein a distance from the head to the housing is adjustable. In still another embodiment, the lock includes an adjustment element for adjusting the distance from the head to the housing.

In another aspect, the technology relates to a lock including: a housing; a locking element adapted to extend from the housing; and a lock mechanism for moving the locking element from a first position to a second position, wherein the locking element at least partially deflects into the housing upon application of a force to the locking element. In an embodiment, at least a portion of the locking element deflects into the lock mechanism upon application of the force. In another embodiment, the lock includes a spring to bias the locking element outward from the housing. In yet another embodiment, when in the first position and the second position, the locking element projects a predetermined distance from the housing. In still another embodiment, the lock includes at least one adjustment element for adjusting the predetermined distance.

In another aspect, the technology relates to a method of locking a frame having a keeper to a door having a lock including a housing, a first locking element projecting from the housing, and an actuator for moving the first locking element from an unlocked position to a locked position, the method including the steps of: placing a locking edge of the door in contact with a locking edge of the frame, such that the first locking element extends into a first opening defined by the keeper; and actuating the actuator so as to move the first locking element from the unlocked position to the locked position. In an embodiment, the placing step includes placing a second locking member into a second opening defined by the keeper. In another embodiment, the first locking member and the second locking member are separated by a first distance in both the unlocked position and the locked position.

In another aspect, the technology relates to a method of retrofitting a multi-point lock into a door panel, the method including the steps of: removing an existing lock from an opening defined by the door panel; and inserting the multi-point lock into the opening defined by the door panel, wherein the multi-point lock includes: a housing; a slide mechanism adapted to translate in the housing along a locking axis; and a plurality of locking elements connected to the slide mechanism, the locking elements adapted to translate along the locking axis with the slide mechanism.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
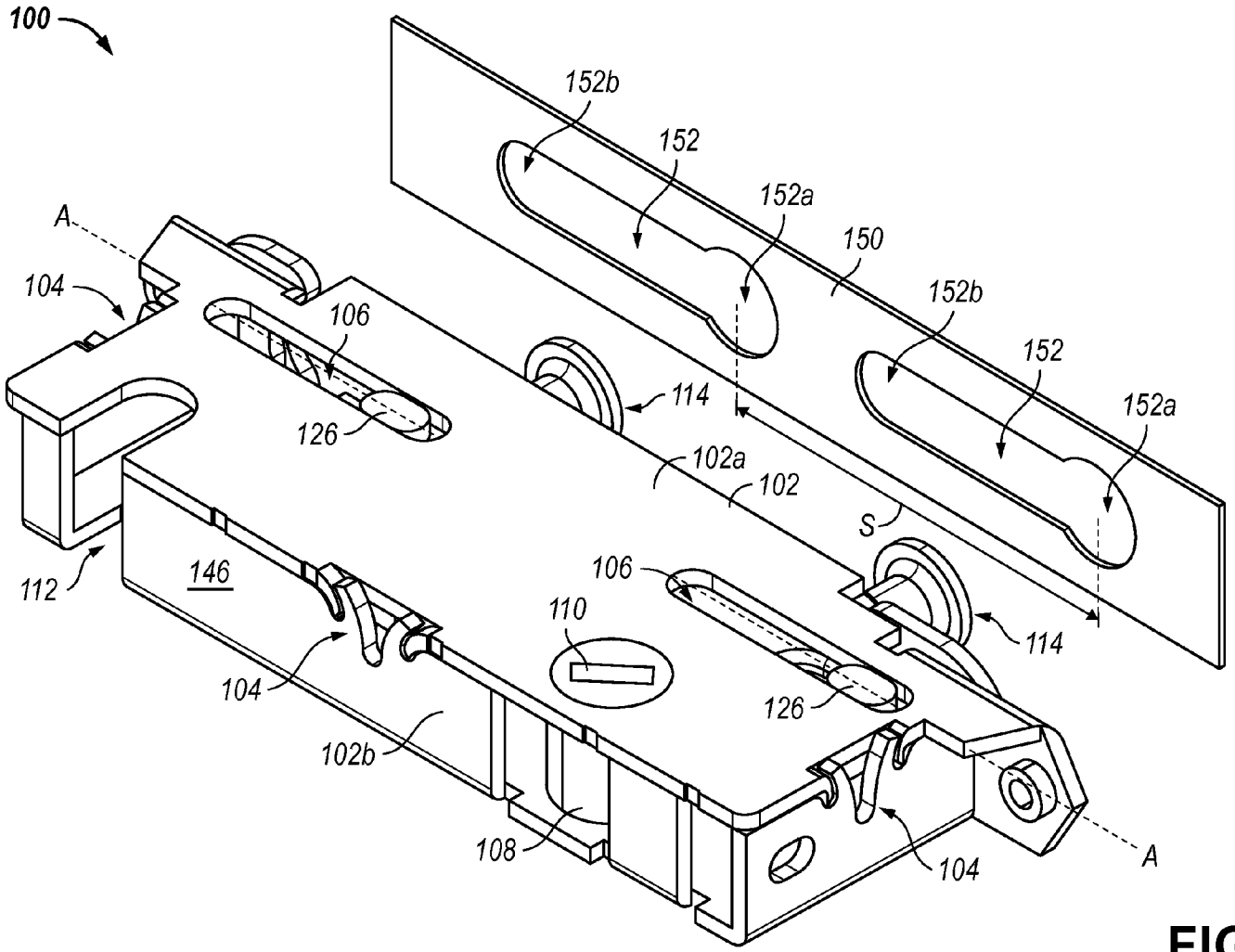
FIG. 1 is a perspective view of a multi-point lock.
Figure 2:
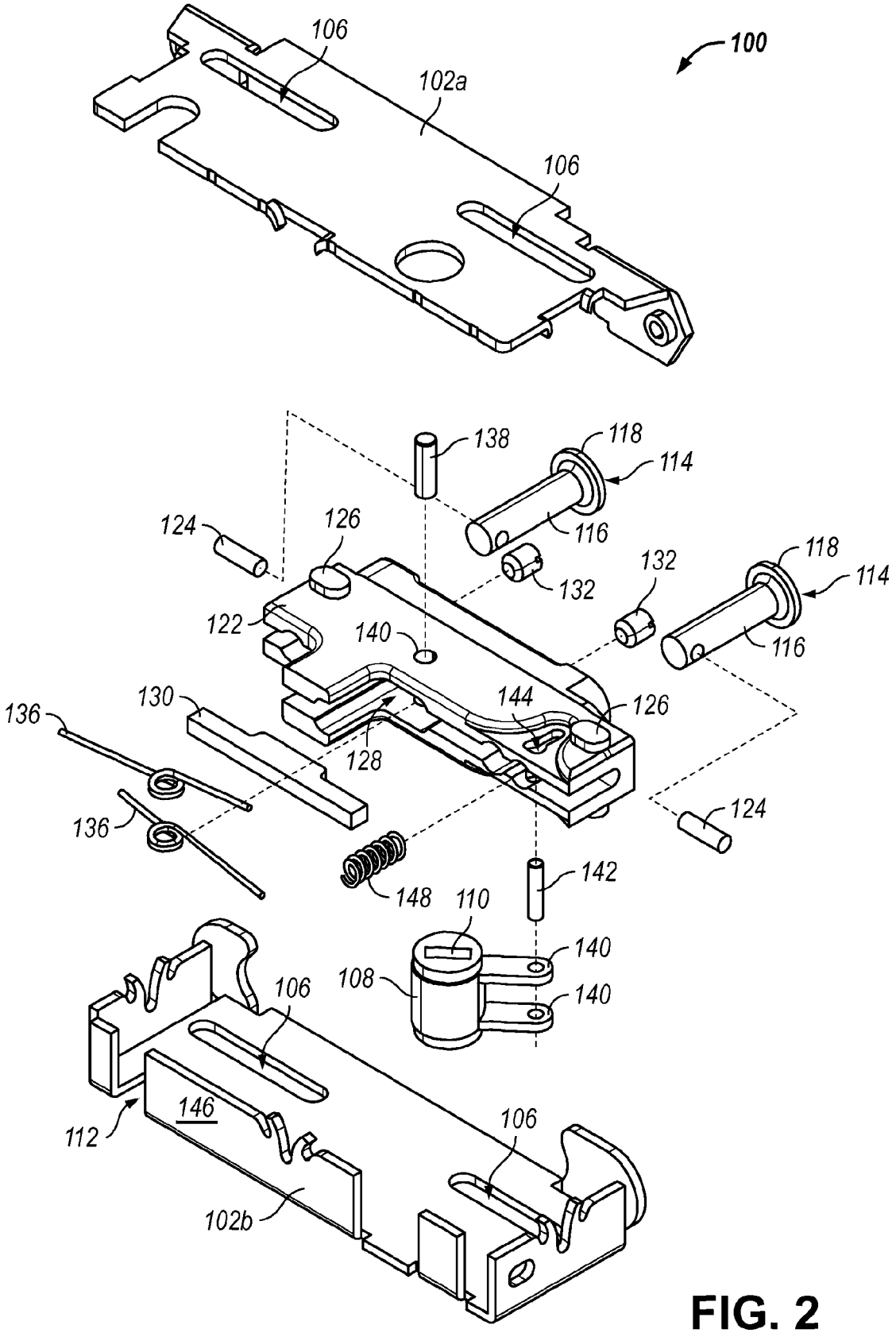
FIG. 2 is an exploded perspective view of a multi-point lock.

FIGS. 1 and 2 depict one embodiment of a multi-point lock (MPL) 100. A typical application for the locks depicted and described herein is for securing sliding glass doors. A person of skill in the art will recognize, however, the many applications that may be appropriate for the depicted locks. The multi-point locks depicted herein may be used for patio, entry, locker, or other doors, as well as sliding windows. Regardless, for clarity, a sliding door lock application will be described below. Additionally, the multi-point locks depicted herein may also be ganged together to form multiple-assembly locks, such as those depicted in U.S. Provisional Patent Application No. 61/422,867, filed Dec. 28, 2010, entitled "System and Method for Ganging Locks," the disclosure of which is hereby incorporated by reference herein in its entirety.

The MPL 100 includes a housing 102 that includes an inner housing portion 102*a* and an outer housing portion 102*b*. As used herein, the terms "inner" and "outer" refer to the side of the housing 102 that faces the inner or outer side of a door, and should not be considered limiting. Depending on the orientation of the MPL 100, either side of the housing 102 may face either side of the door in which it is installed. The inner housing portion 102*a* and the outer housing portion 102*b* are joined at one or more swaging points 104, although other devices, such as bolts, screws, chemical adhesives, etc., or combinations thereof, may be used to join the portions 102*a*, 102*b*. In this embodiment, each of the portions 102*a*, 102*b* defines one or more projection slots 106 that are oriented substantially parallel to a locking axis A. The housing 102 also contains an actuation cam 108 that defines a slot 110 for receiving a tailpiece from a thumbturn or a key cylinder. One or both portions 102*a*, 102*b* of the housing 102 may partially or completely define one or more additional openings 112. When the MPL 100 and associated handles are installed in a door, elongate bolts, screws, or other fasteners secure the outer and inner sliding door handles to each other. The openings 112 allow these elongate fasteners to pass through the housing 102 of the MPL 100. It should be noted that openings 112 that surround the fastener will increase strength of the MPL, preventing it from being pried from the door.

One or more locking elements 114 project from the housing 102, generally in a direction that is substantially orthogonal to the locking axis A. Although an MPL 100 having two locking elements 104 is depicted, the benefits of the technology described herein are equally applicable to similarly-configured locks having a single locking element, or more than two locking elements. The locking elements 114 include a shaft 116 and an enlarged head 118, but other configurations are also contemplated. For example, the head may be a curved or angular hook, coil, or other configuration that will secure the locking element 114 in a keeper when a door utilizing the MPL 100 is in a locked position. The shaft 116 of each locking element 114 is inserted into a bore 120 (see, e.g., FIG. 3C) formed within a slide mechanism 122. A hardened locking element pin 124 prevents the locking element 114 from being pulled from the bore 120. Additionally, the locking element pin 124 helps control a projection distance d of the head 118, as described in more detail with regard to FIGS. 3A-4C.

The lock mechanism includes a number of parts. The slide mechanism 122, in certain embodiments, may be the largest component of the lock mechanism, so as to support the locking elements 114, as described below. The slide mechanism 122 is adapted to slide or translate in the housing 102 in a direction parallel with the locking axis A. In general, the slide mechanism 122 may be any configuration required to support the locking elements 114 and engage with the cam 108. The slide mechanism 122 includes one or more projections 126 configured to slide within the projection slots 106. In the depicted embodiment, the slide mechanism 122 defines a hollow interior 128. Within the interior 128 are a number of components that bias the locking elements 114 outward from the housing 102 and control the projection distance d of the head 118. An adjustment plate 130 contacts the locking pin element 124 and moves within the slide mechanism 122 by adjusting one or more adjustment elements 132 that penetrate a locking face 134 of the MPL 100. In alternative embodiments, the adjustment plate 130 may contact the locking elements 114 directly, for example, by contacting a projection extending from the shaft 116 of the locking element 114. In certain embodiments, the adjustment elements 132 may be shanks or screws that may be rotated in a first direction within the slide mechanism 122 to move the adjustment plate 130 away from the locking face 134. Rotating the shank 132 in a second opposite direction moves the adjustment plate 130 toward the locking face 134.

One or more bias springs 136 (in the depicted embodiment, leaf springs) bias the locking elements 114 toward the locking face 134 of the MPL 100, out of the housing 102. The bias springs 136 may act directly on the locking elements 114 or may apply a force to a separate element, such as the locking element pin 124, which in turn applies the bias force to the locking element 114. A bias spring pin 138 passes through a bias spring pin hole 140 in the slide mechanism 122 to support the bias spring 136. Other types of springs, such as coil or other springs, may be utilized. In an embodiment of an MPL utilizing a coil spring, bias spring pin 138 may be replaced with a small bar or platform to support the coil spring a the end opposite the end that contacts the adjustment plate 130. Alternatively, individual coil springs may be used to apply force directly to each locking element 114, and may either draw the locking element 114 toward the front face 134, or force the locking element 114 toward the front face 134. The anti-slam function of the bias springs 136 is described in more detail below with regard to FIGS. 5A-5C.

Figure 3A:
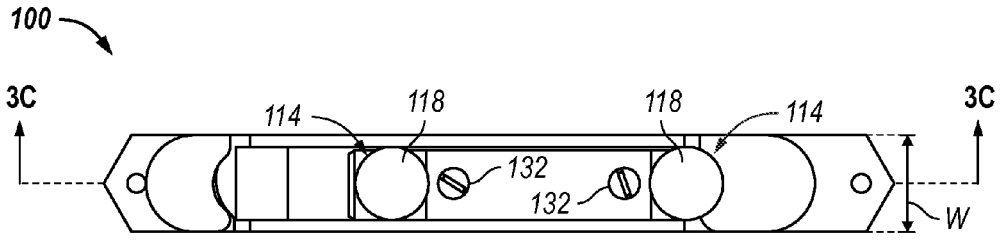
FIG. 3A-3C are top, side and section views, respectively, of a multi-point lock in an unlocked position.

FIGS. 3A-5C depict operation of the MPL 100. The cam 108 actuates the MPL 100, moving the slide mechanism 122 from a first, unlocked position (as depicted in FIGS. 3A-3C) to a second, locked position (as depicted in FIGS. 4A-4C). The cam 108 is fixed to at least one link 140 and a linkage pin 142. The linkage pin 142 is slidably engaged with a linkage pin slot 144 defined by the slide mechanism 122. This relationship is more clearly depicted in FIGS. 3C, 4C and 5C. The linkage pin slot 144 includes a forward end (proximate the locking face 134 of the MPL 100) and a rearward end (proximate a rear face 146 of the MPL 100). Throughout the range of motion of the cam, from the first, unlocked position (FIGS. 3A-3C) to the second, locked position (FIGS. 4A-4C), an overcenter spring 148 biases the linkage pin 142 toward the rearward end of the linkage pin slot 144. As the cam 108 rotates R counterclockwise (as depicted in FIG. 3B), the linkage pin 142 moves towards the forward end of the linkage pin slot 144, while being biased in the opposite direction by the overcenter spring 148. As the cam 108 continues to rotate R, the linkage pin 142 reaches the top of its arcing movement, proximate the forward end of the linkage pin slot 144. Just past the top of the rotation, the force applied to the linkage pin 142 by the overcenter spring 148 forces the cam 108 to complete its rotation R counterclockwise, as the linkage pin 142 is forced rearward within the linkage pin slot 144. This forces the locking elements 114 to engage with a keeper 150. The range of motion of the cam 108 in the depicted MPL 100 is approximately 90 degrees, from the fully unlocked position to the fully locked position. Other ranges of motion are contemplated, but the configuration depicted herein allows for simplified locking that is assured due to the use of the overcenter spring 148. Additionally, inclusion of the overcenter spring 148 presents the MPL 100 from being defeated if a force is applied to the locking elements 114.

Figure 3B:
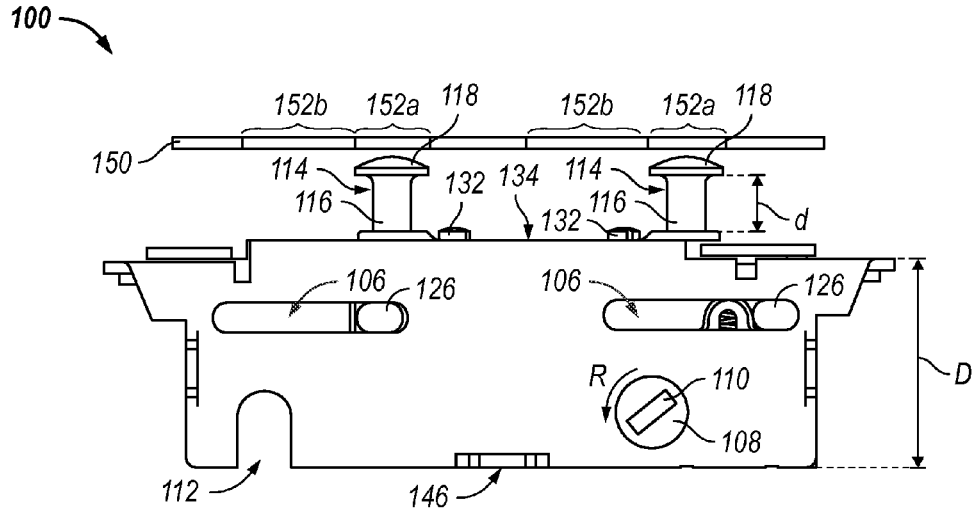

The MPL 100 is of a standard size, namely, about 3¼ inches long (represented by "L" in FIG. 3C), by about ½ inch wide (represented as "W" in FIG. 3A), by about 1⅛ inches deep (represented by "D" in FIG. 3B). These dimensions are typical of most single-point locks, allowing the multi-point lock disclosed herein to be retrofitted into a door or panel P that utilizes a single-point lock. In a retrofit application, an existing lock having similar dimensions may be removed from a door panel P. Since the dimensions of the MPLs described herein are similar to standard single-point locks, a new MPL may be easily installed in the existing lock mortise opening in the panel P. In many cases, the lock mortise opening need not be modified or otherwise increased in size to accommodate the new MPL. Thereafter, an existing keeper may be removed and a new keeper configured to match the MPL may be installed. Some modification to the door frame may be required or desired for installation of the keeper.

The keeper 150 is typically a flat plate defining a number of openings 152 that correspond to the number of locking members 114 on a matching MPL 100. The openings 152 include an enlarged portion 152*a* and a reduced portion 152*b*. The enlarged portion 152*a* is sized to receive the head 118 of the locking element 114 when the panel P is closed against a door frame F (see FIGS. 3C, 4C and 5C). A separation distance S between the centers of the enlarged portions 152*a* is defined by the distance between the locking elements 114. In certain embodiments, the separation distance S of the locking elements 114 may be the same in the unlocked and locked positions. In embodiments where the locking elements move in opposite directions, the separation distance S in the unlocked position will be different than in the locked position. Of course, if a single locking element 114 is utilized, only a single opening 152 need be present on the keeper. The reduced portion 152*b* is smaller than the head 118, typically just slightly larger than the shaft 116 of the locking element 114. This reduced size prevents the head 118 from being pulled from the keeper 150, and the MPL 100 defeated.

Figure 4A:
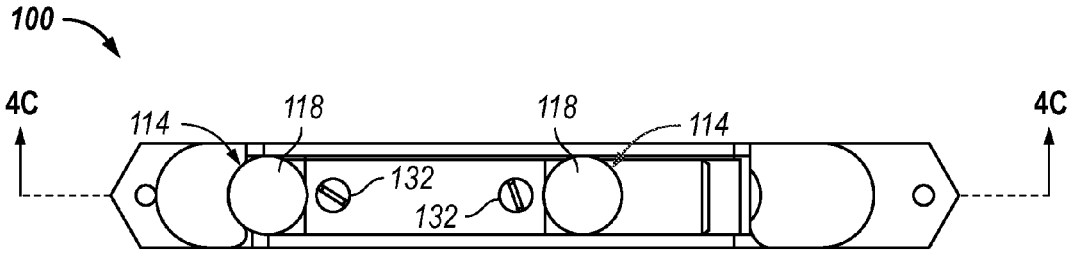
FIGS. 4A-4C are top, side and section views, respectively, of a multi-point lock in a locked position.
Figure 4B:
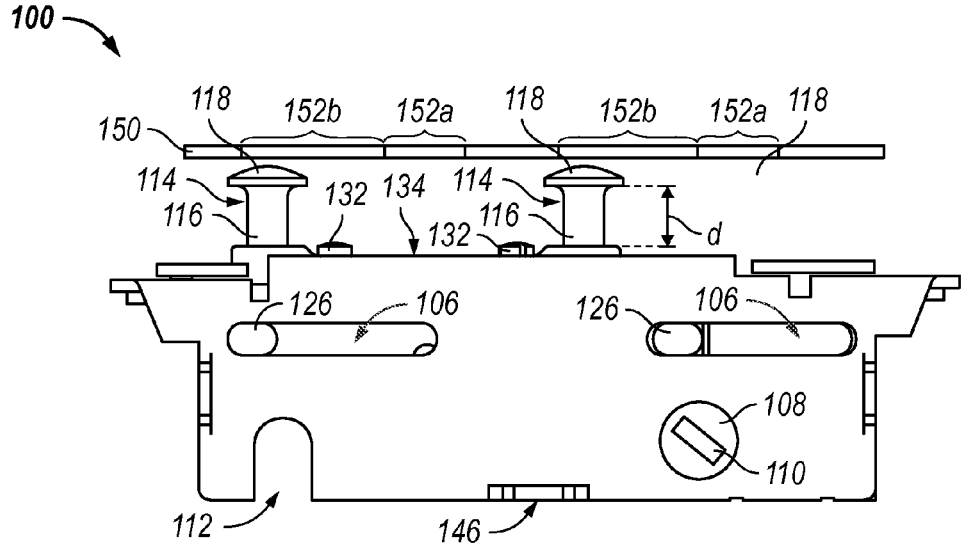
Figure 4C:
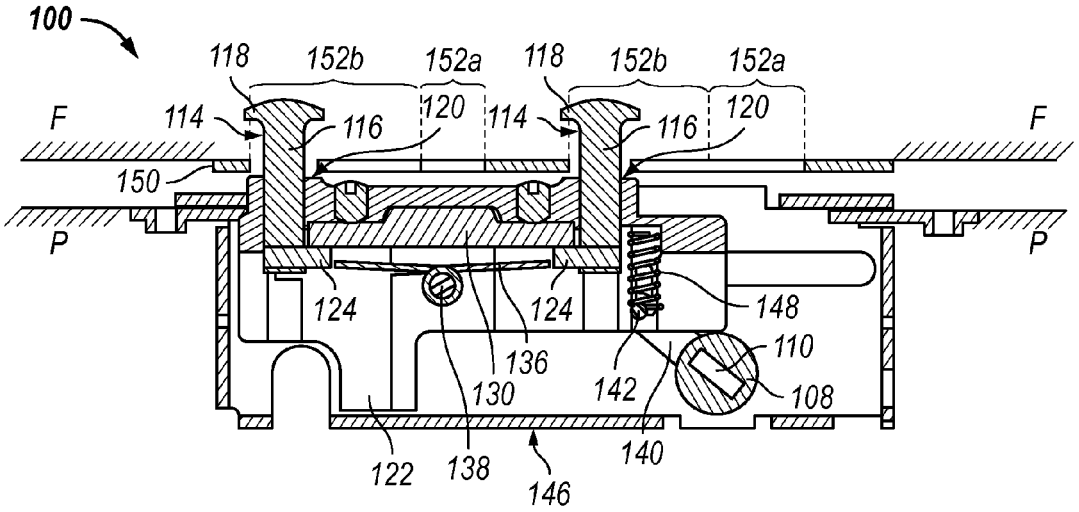
Figure 5A:
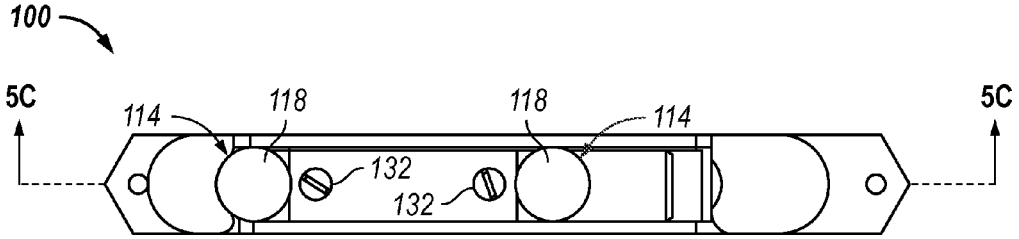
FIGS. 5A-5C are top, side and section views, respectively, of a multi-point lock in an anti-slam position.
Figure 5B:
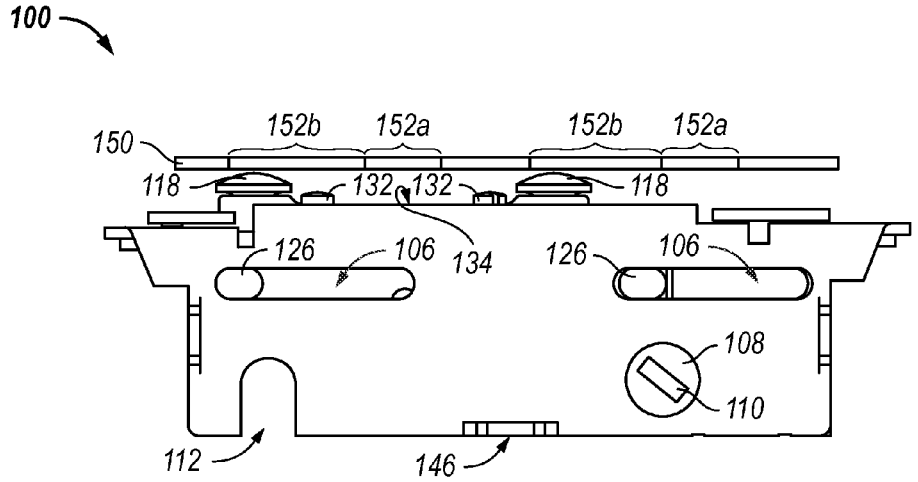
Figure 5C:
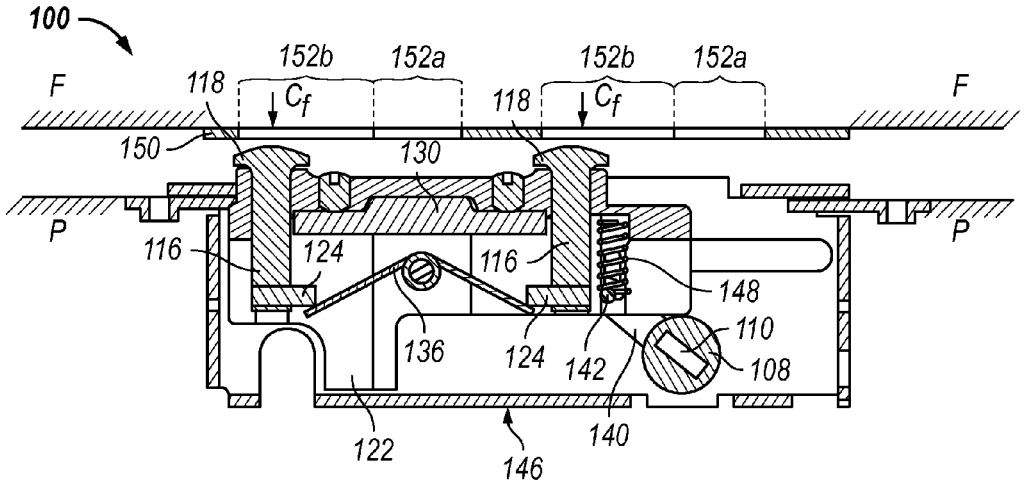

The projection of the locking elements 114 out of the housing 102, however, leads to a risk that damage to the frame F may occur if the panel P is closed while the MPL 100 is in the second, locked position depicted in FIGS. 4B-4C. Since the reduced portion 152*b* of the opening 152 is smaller than the head 118 of the locking element 114, closing the panel P under this condition will cause the head 118 to slam into the keeper 150. The MPL 100 disclosed herein, however, incorporates an anti-slam mechanism that limits or eliminates damage that would otherwise occur to the MPL 100 or frame F. FIGS. 5A-5C depict what occurs if the MPL 100 is closed against the keeper 150, while the locking elements 114 are in the second, locked position. Since the shafts 116 of the locking elements 114 are located in the bores 120 of the slide mechanism 122, a contact force $C_f$ acting against the heads 118 causes the locking elements 114 to deflect into the housing 102, towards the rear face 146. The contact force $C_f$ is generally orthogonal to the locking axis A, but both the force and deflection may be dictated by the configuration of the MPL 100 and the keeper 150. Upon retraction of the panel P away from the frame F, the bias springs 136 bias the locking elements 114 outward from the housing 102. Of course, the elements required for anti-slam functionality need not be included, and the locking element shafts 116 may be fixed within the bores 120.

Figure 3C:
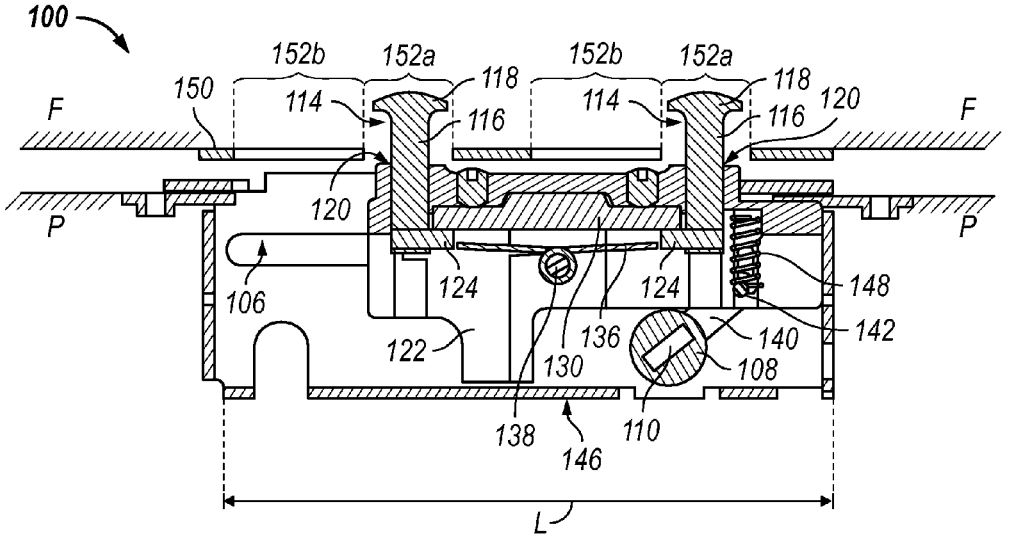
Figure 6:
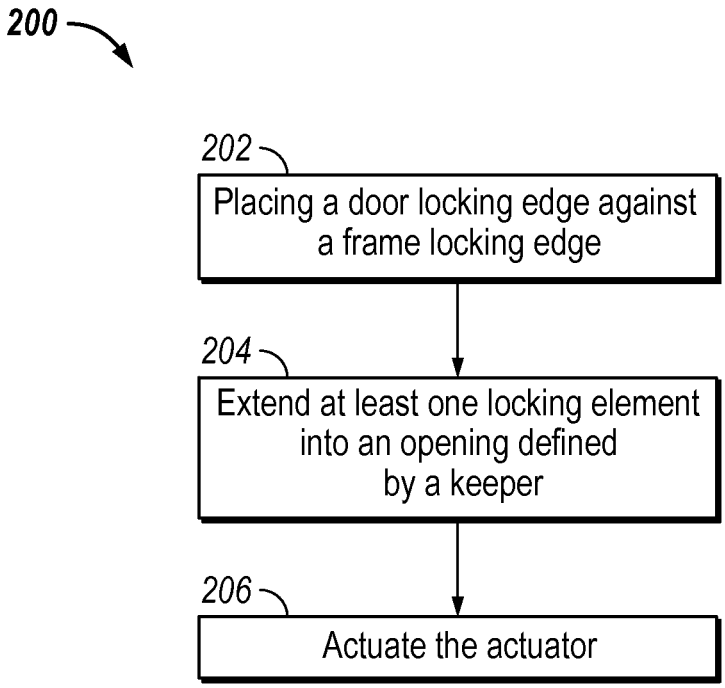
FIG. 6 depicts a method of locking a door to a frame with a lock.

FIG. 6 depicts a method 200 of locking a door to a frame. In this method, the frame includes a keeper, which may be the keeper disclosed herein. The door includes the lock, which may be the lock disclosed herein. Alternatively, a lock having a single locking element or more than two locking elements may be utilized. Of course, the number of openings in the keeper should meet or exceed the number of locking elements utilized in the lock. In an alternative embodiment, the lock may be located on the door frame and the keeper may be located on the door. The door is first placed in contact with the door frame 202. With a sliding door, this means the door is slid into position such that the locking edges of the door and the door frame are facing and/or substantially contacting each other. Since the locking elements extend from the lock housing, as depicted in FIGS. 3A-3C, once the door is placed in substantial contact with the door frame, the locking element (s) will extend into the one or more openings defined by the keeper 204. This may occur substantially simultaneously with the locking edge and the door frame being placed in contact. Thereafter, the actuator is actuated 204, typically by turning the cam with a thumbturn or lock cylinder, so as to move the locking elements from a first, unlocked position to a second, locked position.

The entire MPL or components thereof may be manufactured by known techniques using tooled, cast, or stamped metals typically used in the door hardware industry. Such materials may include, but are not limited to, various grades of stainless steel, zinc, brass, etc. Additionally, depending on the application and desired robustness of components, certain components may be manufactured of various injection molded plastics, including PVC, ABS, or other plastics.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A lock comprising:

a housing;

a cam rotatably mounted in the housing from a first operating position to a second operating position;

a slide mechanism adapted to translate in the housing along a locking axis, wherein the slide mechanism comprises a slot substantially orthogonal to the locking axis; a linkage fixed to the cam;

a pin coupled to the linkage and being slidably engaged with the slot of the slide mechanism, wherein rotation of the cam moves the slide mechanism from a first position to a second position;

a locking element connected to the slide mechanism, the locking element adapted to translate along the locking axis with the slide mechanism; and an overcenter spring for biasing the pin, wherein the force exerted on the pin by the overcenter spring forces the cam into both the first operating position and the second operating position.

2. The lock of claim 1, wherein the locking element is deflectably connected to the slide mechanism, such that a force applied to the locking element substantially orthogonal to the locking axis deflects the locking element into the housing.

3. The lock of claim 2, wherein the locking element is biased outward from the housing.

4. The lock of claim 1, wherein the locking element comprises at least two locking elements.

5. The lock of claim 1, wherein the housing defines at least one slot, wherein the slot is substantially parallel to the locking axis.

6. The lock of claim 5, wherein the sliding mechanism is slidably engaged with the slot.

7. The lock of claim 1, wherein the locking element comprises a head, wherein a distance from the head to the housing is adjustable.

8. The lock of claim 7, further comprising an adjustment element for adjusting the distance from the head to the housing.

9. A lock comprising:

a housing;

a rotatable cam disposed within the housing between a first operating position and a second operating position;

a lever fixed to the cam and disposed within the housing;

a locking element adapted to extend from the housing;

a lock mechanism disposed within the housing for moving the locking element from a first position to a second position, wherein the locking element at least partially deflects into the lock mechanism upon application of a force to the locking element;

a pin disposed within the housing, the pin connecting the lever to the lock mechanism at a slot defined by the lock mechanism, wherein the slot is disposed substantially orthogonal to a locking axis at least partially defined by the first position and the second position; and an overcenter spring for biasing the pin, wherein the force exerted on the pin by the overcenter spring forces the cam into both the first operating position and the second operating position.

10. The lock of claim 9, wherein at least a portion of the locking element deflects into the lock mechanism upon application of the force.

11. The lock of claim 9, further comprising a spring to bias the locking element outward from the housing.

12. The lock of claim 9, wherein when in the first position and the second position, the locking element projects a predetermined distance from the housing.

13. The lock of claim 12, further comprising at least one adjustment element for adjusting the predetermined distance.

* * * * *